US010010237B1

(12) United States Patent
Dirisala et al.

(10) Patent No.: US 10,010,237 B1
(45) Date of Patent: Jul. 3, 2018

(54) DISHWASHER DOOR ASSEMBLY

(71) Applicant: WHIRLPOOL CORPORATION, Benton Harbor, MI (US)

(72) Inventors: Venkata S. Dirisala, Benton Harbor, MI (US); Aaron P. Bennett, Saint Joseph, MI (US); Amirkhan A. Modi, Maharashtra (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/628,903

(22) Filed: Jun. 21, 2017

(51) Int. Cl.
*A47L 15/00* (2006.01)
*A47L 15/42* (2006.01)

(52) U.S. Cl.
CPC ..... *A47L 15/4265* (2013.01); *A47L 15/42* (2013.01); *A47L 15/4263* (2013.01)

(58) Field of Classification Search
CPC ... A47L 15/4265; A47L 15/42; A47L 15/4209
See application file for complete search history.

(56) References Cited

U.S. PATENT DOCUMENTS 5,157,893 A * 10/1992 Benson ..... A47J 27/002 52/789.1
5,965,851 A * 10/1999 Herreman ..... B32B 5/26 181/200
7,981,222 B2 * 7/2011 Colon ..... A47L 15/4209 134/200
9,084,527 B2 * 7/2015 Haft ..... A47L 15/4257
9,179,817 B2 * 11/2015 Fritz ..... A47L 15/4209
2005/0079739 A1 * 4/2005 Illerhaus ..... D06F 39/12 439/33
2006/0068169 A1 * 3/2006 Hanada ..... B32B 5/18 428/158
2006/0266385 A1 * 11/2006 Malaker ..... A47L 15/4246 134/56 D
2010/0148644 A1 * 6/2010 Poyner ..... A47L 15/421 312/228
2010/0180916 A1 * 7/2010 Colon ..... A47L 15/4257 134/18
2015/0151509 A1 * 6/2015 Tompkins ..... B32B 5/145 428/158

FOREIGN PATENT DOCUMENTS

CN 205359398 U 7/2016
WO 2015101865 A1 7/2015

* cited by examiner

*Primary Examiner* — Daniel J Rohrhoff
(74) *Attorney, Agent, or Firm* — McGarry Bair PC

(57) ABSTRACT

A dish treating appliance for treating dishes having a tub at least partially defining a treating chamber with an access opening and a door movable between opened/closed positions to selectively open/close the access opening. The door having an inner door panel confronting the treating chamber in the closed position, and an outer door panel spaced from the inner door panel to define a door cavity there between. A foam panel located within the door cavity, the foam panel have areas of differing densities.

16 Claims, 3 Drawing Sheets

DISHWASHER DOOR ASSEMBLY

BACKGROUND OF THE INVENTION

Home appliances, such as a dishwasher for example, are assembled from a large number of different parts, some of quite different materials, in a complex way. Many of the parts are secured in a housing of some kind. For example, dishwashers generally have a cabinet defining a treating chamber and having an opening through which dishes loaded/unloaded on one or more movable racks. A door selectively opens/closes the access opening. The door typically includes an inner panel, confronting the treating chamber, and an outer panel, opposite and spaced from the inner panel to define a door interior in which various components of the dishwasher can be mounted and through which conduits or lines, such as wiring (power and data) can be routed.

SUMMARY

One exemplary embodiment is a dish treating appliance for treating dishes having a tub at least partially defining a treating chamber with an access opening and a door movable between opened/closed positions to selectively open/close the access opening. The door having an inner door panel confronting the treating chamber in the closed position, and an outer door panel spaced from the inner door panel to define a door cavity there between. A foam panel located within the door cavity, the foam panel have areas of differing densities.

Another exemplary embodiment is a foam panel for use in a dish treating appliance. The foam panel is a foam panel having areas of differing densities. The densities resulting from the panel have uncompressed and compressed areas. The foam panel also has at least one wiring attachment provided with the foam panel wherein the wiring attachment forms at least one rib in the foam panel.

DETAILED DESCRIPTION

Figure 1:
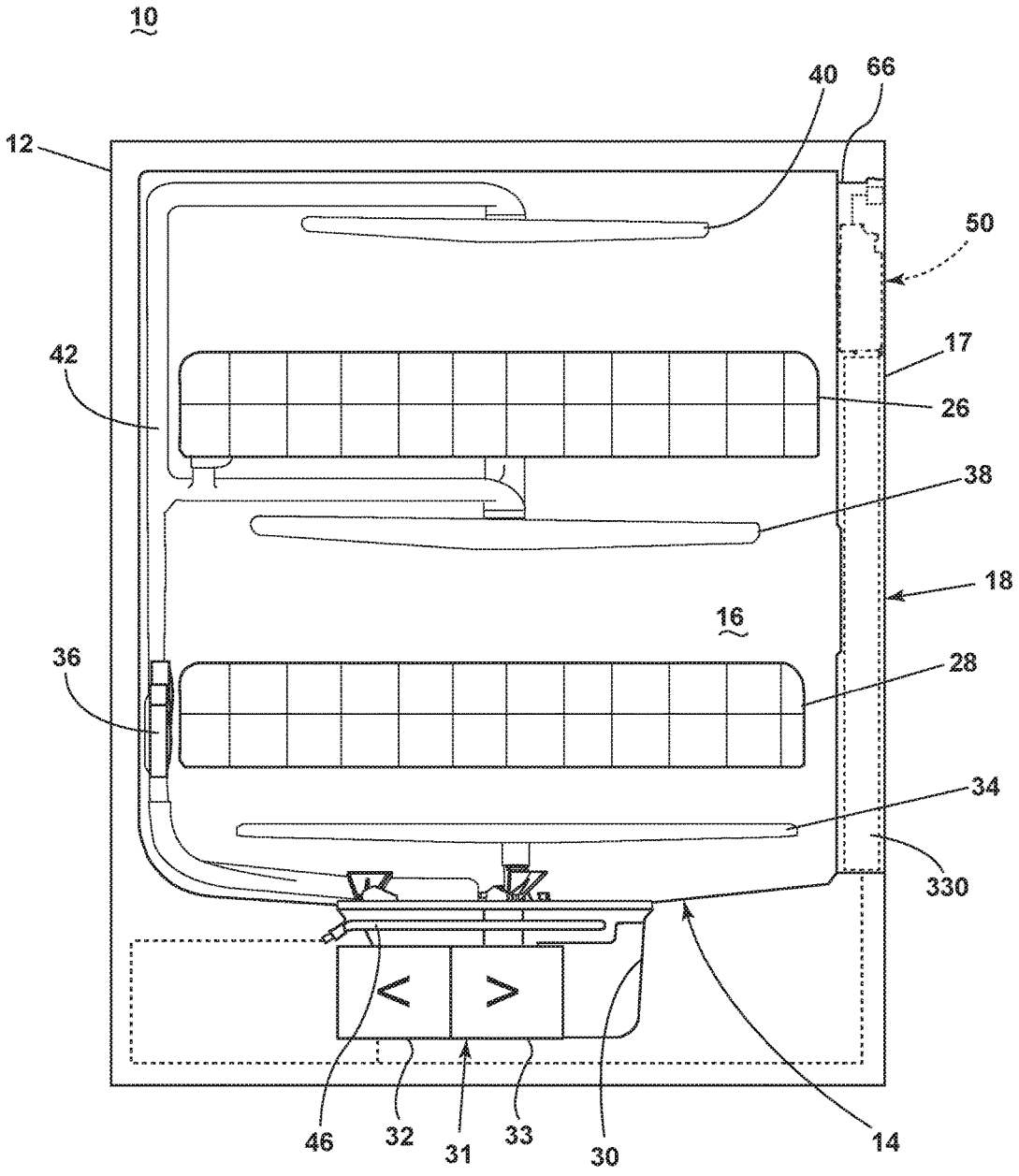
FIG. 1 is a schematic, cross-sectional view of a dish treating appliance.

FIG. 1 is a schematic, cross-sectional view, of a dish treating appliance such as a dishwasher 10. The dishwasher 10 shares many features of a conventional automated dishwasher, which will not be described in detail herein except as necessary for a complete understanding of the invention. A chassis 12 can define an interior of the dishwasher 10 and can include a frame, with or without panels mounted to the frame. A tub 14 having an open face or access opening 17 can be provided within the chassis 12 and can at least partially define a treating chamber 16, having an open face for washing dishes.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders can be provided, such as a silverware basket. As used in this description, the term "dish(es)" is intended to be generic to any item, single or plural, that can be treated in the dishwasher 10, including, without limitation, dishes, plates, pots, bowls, pans, glassware, and silverware.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system can include a sump 30 and a pump assembly 31. The sump 30 collects the liquid sprayed in the treating chamber 16 and can be formed by a sloped or recess portion of a bottom wall of the tub 14. The pump assembly 31 can include both a drain pump 32 and a recirculation pump 33. The drain pump 32 can draw liquid from the sump 30 and pump the liquid out of the dishwasher 10 to a household drain line (not shown). The recirculation pump 33 can draw liquid from the sump 30 and the liquid can be simultaneously or selectively pumped through a supply tube 42 to each of the assemblies 34, 36, 38, 40 for selective spraying. While not shown, a liquid supply system can include a water supply conduit coupled with a household water supply for supplying water to the treating chamber 16.

A heating system including a heater 46 can be located within the sump 30 for heating the liquid contained in the sump 30.

A controller 50 can also be included in the dishwasher 10, which can be operably coupled with various components of the dishwasher 10 to implement a cycle of operation. The controller 50 can also be operably coupled with a control panel or user interface 56 for receiving user-selected inputs and communicating information to the user. The user interface 66 can include operational controls such as dials, lights, switches, and displays enabling a user to input commands, such as a cycle of operation, to the controller 50 and receive information.

A door assembly 18 can be movably mounted to the dishwasher 10 for movement between opened and closed positions to selectively open and close the open face or access opening 17 of the tub 14. Thus, the door assembly provides accessibility to the treating chamber 16 for the loading and unloading of dishes or other washable items.

It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 can be permitted when the door assembly 18 is open.

The door assembly 18 can comprise a foam panel 330 configured to provide various functional properties to the dishwasher 10. For example, the foam panel 330 can provide for sound suppression or absorption to reduce the noise generated in the dishwasher 10 due to operation of moving parts such as pumps 32, 33, sump 30, sprayers 34, 38, 40; and/or noise produced as water is introduced into the tub 14, mixed with a cleaning agent, sprayed on dishware and door, recirculated, and/or discharged; and the sound of dishware being rattled during washing and rinsing cycles. In addition, the foam panel 330 can enhance the energy efficiency of the appliance by providing thermal insulation. Less energy would then be needed to heat the water and keep it heated during operation, yielding cost savings to the appliance operator such as a homeowner.

Figure 2:
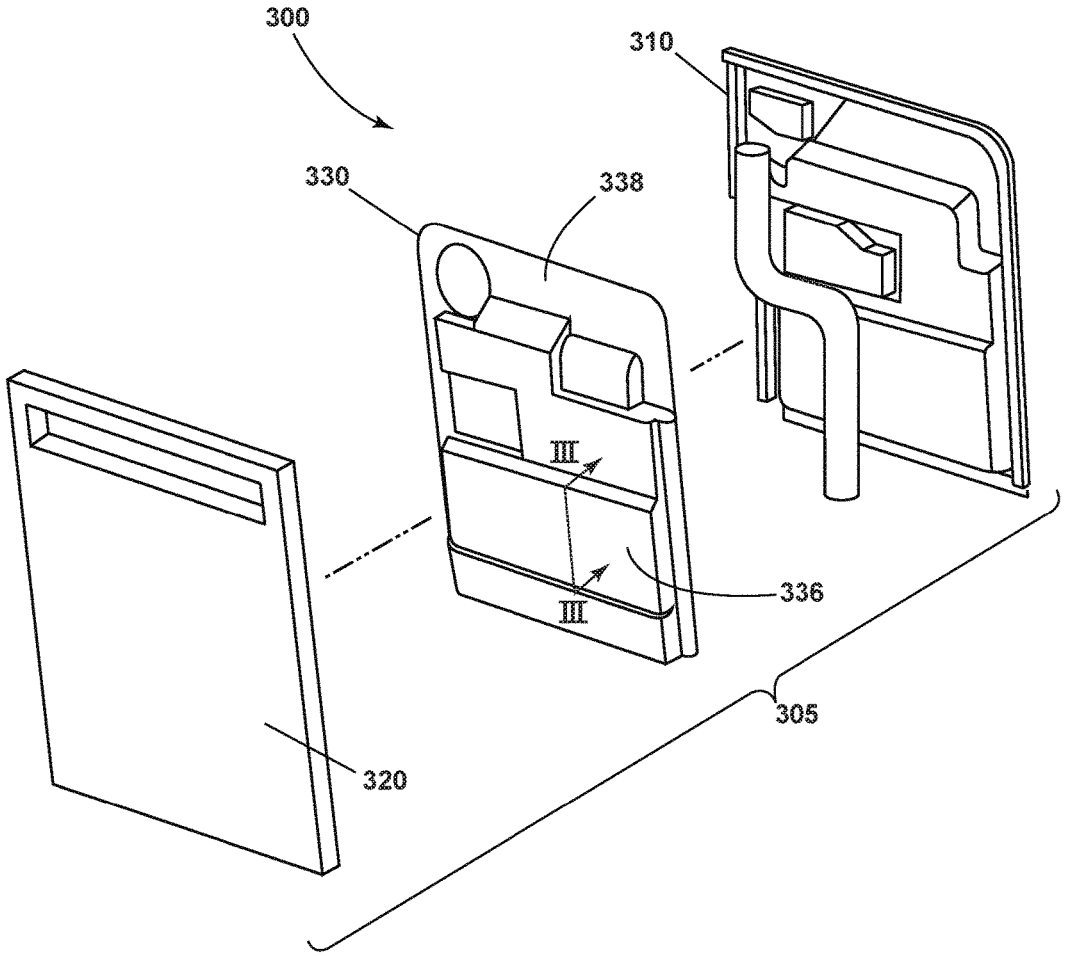
FIG. 2 is an exploded view of the dishwasher door as shown in FIG. 1.

FIG. 2 is an exploded view of a dishwasher door assembly 300 including the foam panel 330. As illustrated, the door assembly 300 can have an inner door panel 310 configured to confront the treating chamber 16 when in the door is in a closed position, and an outer door panel 320 spaced from the inner door panel 310 to define a cavity 305 within the door assembly 300. The door cavity 305 can contain the foam panel 330 having areas of differing densities. For example, the area 338 generally having a greater density than the area 336.

Figure 3:
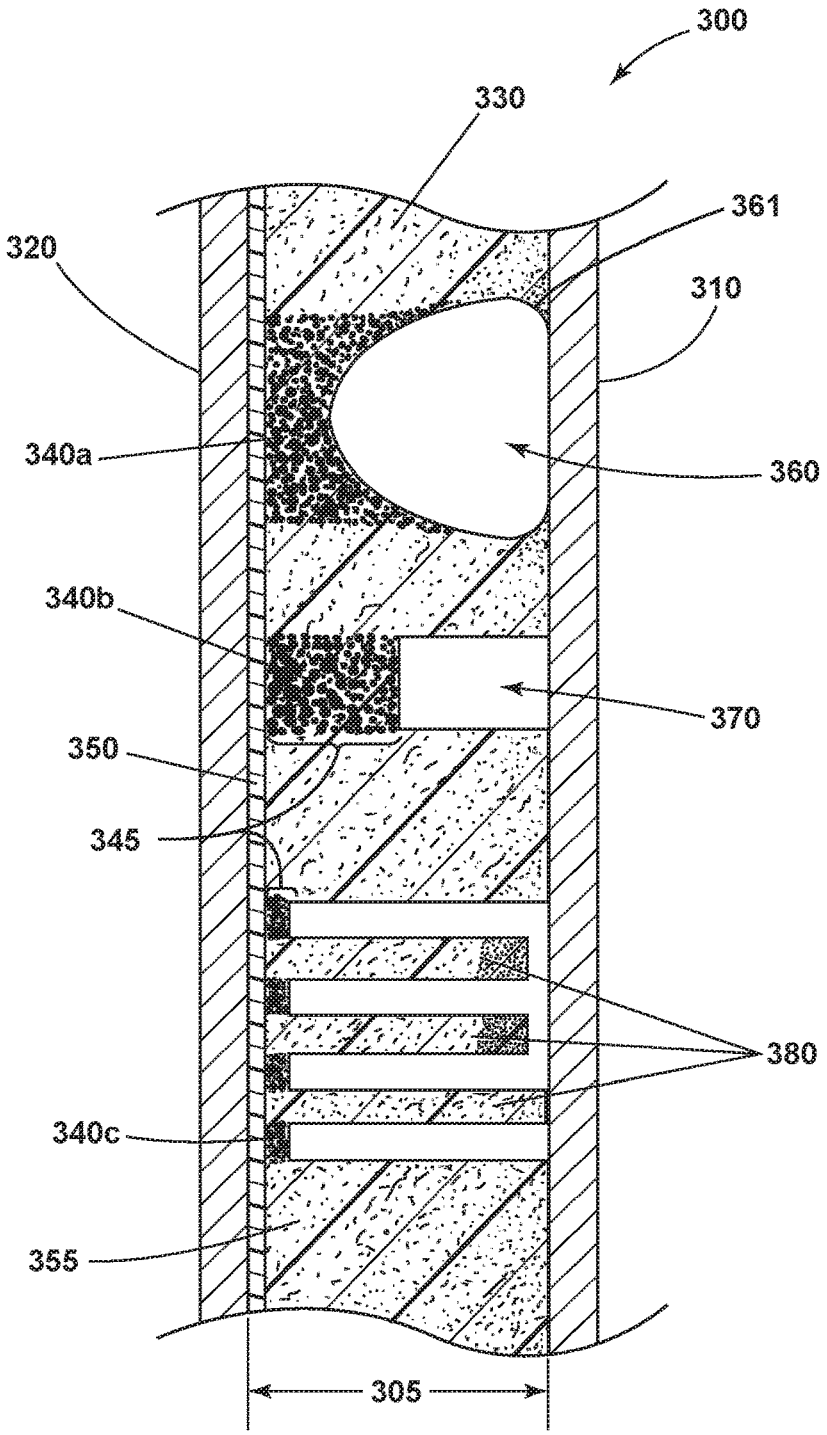
FIG. 3 is a partial cross-sectional view taken along line of FIG. 2 of a portion a dishwasher door assembly.

FIG. 3 is an example of a partial sectional view taken along line of FIG. 2 of the door assembly 300 illustrating the relationship between the inner door panel 310, the outer door panel 320 being spaced from the inner door panel 310, and with the interposed foam panel 330. The foam panel 330 has areas of differing densities 340, illustrated by areas 340*a*, 340*b*, and 340*c* that can be used to form structural features, especially those used for mounting of other components. The structural features can include mounting bosses, such as pin and stubs, walls, or channel structures for receiving components. The channels can be configured to loose-fit or snap-fit a component. These various structures features can simplify and speed manufacture of the appliance and reducing the number of parts that must be purchased, stocked, and assembled. As a result, cost savings can be realized by the manufacturer.

The areas of differing densities 340 in foam panel 330 can be formed in many ways. For example, the differing densities 340 can be formed by compressing certain areas of the foam panel where differing densities are desired. As illustrated, the foam panel 330 shows a variety of compressed areas 345 and uncompressed areas 355. The compressed areas 345 result in those areas generally having a density greater than uncompressed areas 355. For example, area 340*c* generally having a density greater than area 340*a* and 340*b*, and area 340*a* generally having a density greater than area 340*b*. The example foam panel 300 shows examples of compressed areas 345 and uncompressed areas 355 areas, but not necessarily the specific compressed areas 345 of a foam panel 300 used in a specific dishwasher door 18. In addition, while the illustration shows compressed areas 345 on the foam from right to left to accommodate for protrusions on the inner door panel 310, the foam panel 300 could be compressed from either direction to accommodate for protrusion on either the inner door panel 310 or outer door panel 320.

The foam panel 330 can be a closed cell foam and can have areas of differing densities 340 due to the foam panel 330 having various compressed areas 345 and uncompressed areas 355. The compressed and uncompressed areas 345, 355, result in the foam panel 330 having areas of differing densities 340 as indicated in the figure by increased shading/dotting to represent different respective densities in the foam layer 330. In general, the greater the shading/dotting, the greater the density.

As mentioned, the compressed areas 345 and uncompressed areas 355 of the foam panel 330 can be configured to provide areas, pathways, or other defined functional structures. For example, one or more dry duct passageway 360 can be provided with or formed in the foam panel 330 by compressing the foam in that area. Passageway 360 can be formed with tips 361 to allow to a dry duct to essentially snap fit into place. Tips 361 could also be a separate fastener made of plastic or other material and secured to the inner wall of the passageway 360. A wiring attachment 370 can alternatively or additionally be provided with or formed in the foam panel 330. Multiple wiring attachments 370 can also be spaced so as to form one or more wire guide channels. In addition, any desired number of ribs or other structural elements 380 can also be formed. As illustrated, the recess formed by compressed areas 345 can be used to mount duct work, air ducts, wires, or other parts/assemblies associates with a dishwasher door assembly 300. Screws, bolts, clips and other fasteners could be compressed into the foam panel 330 or otherwise used to attach or mount the parts/assemblies of the dishwasher door assembly 300.

In a current exemplary embodiment, the thickness of the foam panel 330 or composite layer can be on the order of about 20 mm in uncompressed areas 355, although other thicknesses can advantageously be used. The compressed areas 345 of foam panel 330 can be molded to be as thin as needed down to about 3 mm. The foam panel 330 can be or comprise cast foam or polyethylene terephthalate (PET) or Foam-PET combination hybrid material or other thermoplastic polymer resin, as is known. A single foam layer can be used, or a multi-layer material (not shown) comprising at least one foam layer can be used. In an embodiment, the foam panel 330 can also be configured in such a way as to replace mastic that would otherwise be required in the inner door panel 310.

The foam panel 330 can be secured to the inner door panel 310, by using a permanent adhesive, although other means of attachment can be used. A moisture barrier in the form a moisture barrier layer 350 can also be provided. The moisture barrier layer 350 can be adhered or otherwise secured to or integrated with the foam panel 330. The moisture barrier layer 350 can be provided on one or both one sides of the foam panel 330. The moisture barrier layer 350 can be a thin sheet or layer of a non-porous waterproof material as is known in the art. For example, the moisture barrier layer 350 can be or include a polyethylene film.

To the extent not already described, the portions features and structures of the various embodiments can be used in combination with each other as desired. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dish treating appliance for treating dishes, comprising:

a tub at least partially defining a treating chamber with an access opening;

a door movable between opened/closed positions to selectively open/close the access opening and having an inner door panel confronting the treating chamber in the closed position, and an outer door panel spaced from the inner door panel to define a door cavity there between;

a foam panel located within the door cavity, the foam panel having compressed and uncompressed areas forming areas of differing densities, and;

one or more fasteners secured into one of the compressed or uncompressed areas.

2. The dish treating appliance of claim 1 wherein the foam panel comprises closed cell foam.

3. The dish treating appliance of claim 1 wherein the foam panel is secured to the inner door panel.

4. The dish treating appliance of claim 3 wherein the foam panel is adhered to the inner door panel to secure the foam panel to the inner door panel.

5. The dish treating appliance of claim 1 further comprising a moisture barrier provided with the foam panel.

6. The dish treating appliance of claim 5 wherein the moisture barrier comprises a moisture barrier layer secured to the foam panel.

7. The dish treating appliance of claim 1 further comprising a dry duct passageway provided with the foam panel.

8. The dish treating appliance of claim 7 wherein the fastener comprises a tip that extends into the passageway.

9. The dish treating appliance of claim 8 further comprising a dry duct configured to snap fit into the passageway.

10. The dish treating appliance of claim 1 further comprising at least one wiring attachment provided with the foam panel.

11. The dish treating appliance of claim 10 wherein the wiring attachment comprises at least one rib formed in the foam panel.

12. The dish treating appliance of claim 1 further comprising compressed areas defining at least one rib.

13. The dish treating appliance of claim 12 wherein the at least one rib is spaced to form a wire guide channel.

14. The dish treating appliance of claim 1 wherein the fasteners are one of metal or plastic.

15. The dish treating appliance of claim 1 wherein the foam panel comprises compressions of at least three different densities.

16. The dish treating appliance of claim 15 the compressions comprising the at least three different densities form a dry duct passageway, a rib and a wiring guide channel.

* * * * *